United States Patent [19]

Collin et al.

[11] 3,947,621

[45] Mar. 30, 1976

[54] FURNACE AND METHOD FOR REDUCING METAL OXIDES TO MOLTEN METAL

[75] Inventors: Per Harald Collin, Falun; Yngve Sundberg, Vasteras, both of Sweden

[73] Assignee: Allmanna Svenska Elektriska Aktiebolaget, Vasteras, Sweden

[22] Filed: Mar. 13, 1975

[21] Appl. No.: 558,177

[30] Foreign Application Priority Data

Mar. 15, 1974 Sweden ..... 7403480

[52] U.S. Cl. ..... 13/23; 13/26; 13/35

[51] Int. Cl.[2] ..... F27B 3/08

[58] Field of Search ..... 13/20, 23, 26, 35, 34

[56] References Cited

UNITED STATES PATENTS

| | | | |
|---|---|---|---|
| 2,594,972 | 4/1952 | Muehlenkamp | 13/23 X |
| 3,244,511 | 4/1966 | Nicaise | 13/23 X |

*Primary Examiner*—R. N. Envall, Jr.
*Attorney, Agent, or Firm*—Kenyon & Kenyon Reilly Carr & Chapin

[57] ABSTRACT

To reduce metal oxides to molten metal, an electrically non-conductive, annular hearth is used, the hearth being radially corrugated to form radial ridges and valleys. A circumferentially continuous coke bed forming a closed electric circuit, is formed on this bed and heated to incandescence by electric current passed through the bed in its circumferential direction, the current being either induced or applied directly. The oxides in particulated form are fed to this bed for reduction to molten metal, the metal collecting in the valleys of the hearth and thereby being prevented from forming a circumferentially continuous melt of higher electrical conductivity than the coke. Particulated coke and oxides can be fed continuously to the bed, the molten metal being then continuously tapped from the valleys of the hearth to thereby prevent the formation of a circumferentially continuous melt.

12 Claims, 11 Drawing Figures

Fig. 1
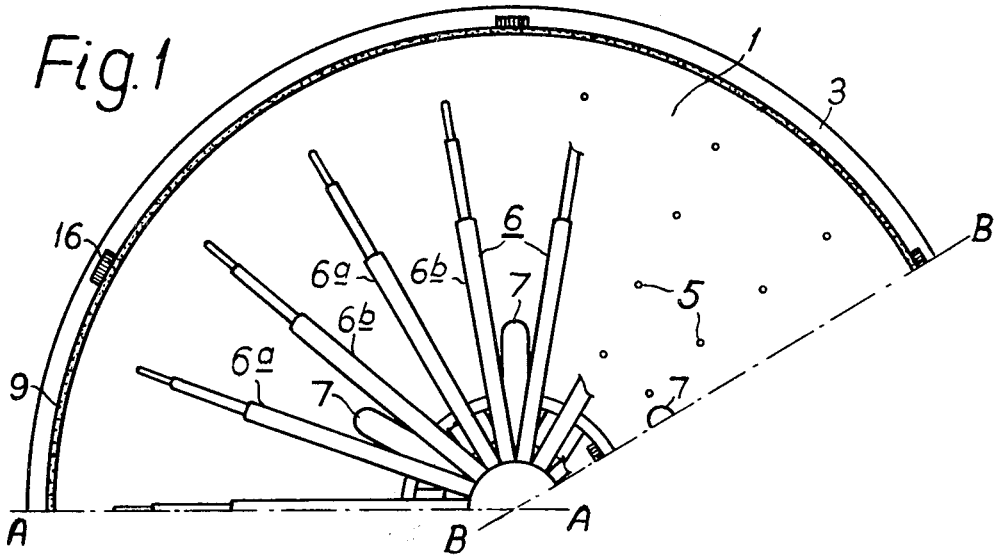
Fig. 2
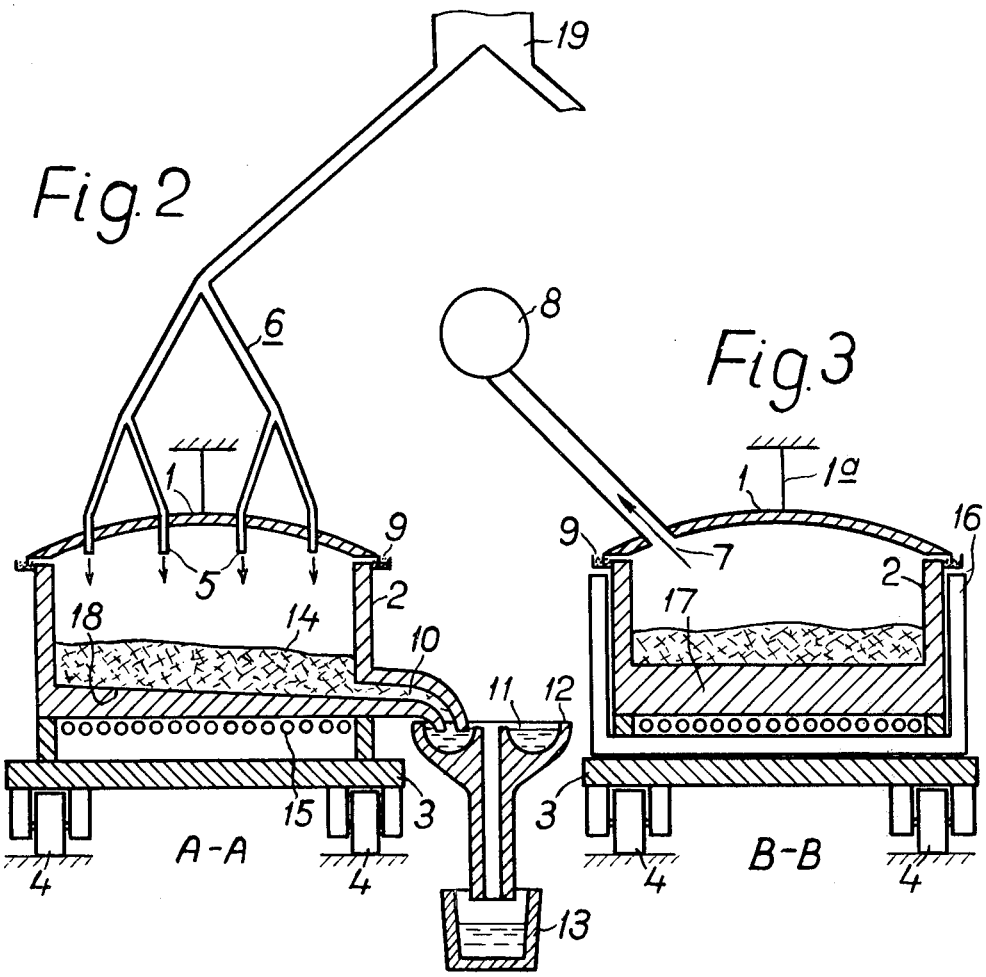
Fig. 3

FURNACE AND METHOD FOR REDUCING METAL OXIDES TO MOLTEN METAL

BACKGROUND OF THE INVENTION

The prior art has proposed the feeding of particulated metal oxides such as iron and nickel ores, possibly partially reduced by a pretreatment, to a coke bed heated to incandescence, meaning a temperature high enough for the coke to react with the oxygen of the oxides and produce molten metal. Also, it has been suggested that the coke bed be electrically heated.

However, there has been no way to electrically heat the coke bed efficiently enough to make the above concept commercially practical. It is, of course, possible to use an electrically non-conductive hearth for carrying the coke bed, but the melt formed by the reduction of the oxides is of high electrical conductivity, the coke bed of substantially lower electrical conductivity, floating on top of the melt. Consequently, any attempt to pass current through the coke bed by any means, inductively or directly, means that the current must be largely shunted through the melt, the coke bed being heated only by conduction from the melt. The maintenance of the coke bed and the feeding of the oxides to this bed, present serious problems.

The object of the present invention is to heat the coke bed electrically by passing a current through the coke bed, without the current being shunted by the molten metal produced from the oxides, while providing for the maintenance of the coke bed and the feeding of the oxides to it in a practicable manner.

SUMMARY OF THE INVENTION

To attain that object, according to the invention, the coke bed is formed on an electrically non-conductive annular hearth having a radially corrugated bottom on which the bed is supported to form an annular electric circuit in the form of a closed loop facilitating electrical heating of the hearth by passing current through the closed circuit it forms. For example, an electric inductor coil or coils applied beneath the hearth can be used to induce current into the closed circuit formed by the coke bed, or heat-resistant electric contacts may be applied to the bed directly, possibly at interspaced locations and powered by appropriately phased AC to form a current traveling through the coke bed.

Upon feeding the particulated oxides to the bed, the reduced molten metal runs into the valleys of the hearth, the hearth's ridges preventing this metal from forming a circumferentially continuous melt which would otherwise form to result in a high conductivity shunt circuit under the coke bed. The hearth is provided with tap holes for its valleys so that the reduced metal is continuously removed, permitting continuous feeding of the oxides to the bed together with additional coke for maintaining the circumferential continuity of the coke bed.

The hearth is enclosed by annular walls and a cover over the hearth, and when the hearth and walls are circular, oscillatory or uniform relative rotation between the hearth and the roof is possible, facilitating distribution of the oxides and coke, through the roof, to the annular coke bed. The tap holes of the valleys can open inwardly and by way of runners, feed the molten metal to a collection point at the axis of the circular parts. The feeding through the roof can be by way of chutes distributed radially with respect to the hearth and roof, and provided with a control timed to feed the coke at least mainly above the hearth's ridges, while the oxides are fed at least mainly in the direction of the hearth's valleys, during any relative rotation between the hearth and the roof through which the feed occurs. The coke bed has a top surface which inherently somewhat follows the contour of the hearth, and, therefore, has a top surface which is to some extent correspondingly radially corrugated to form generally corresponding radial ridges and valleys, feeding of the oxides at positions circumferentially displaced from the ridges providing further assurance that the molten metal will be prevented from forming a circumferentially continuous melt, by the ridges of the hearth bottom.

BRIEF DESCRIPTION OF THE DRAWINGS

Examples of the present invention are schematically illustrated by the accompanying drawings, in which:

FIG. 1 is a horizontal cross section showing a portion of a furnace embodying the principles of this invention, this view showing only a sector but with the understanding that a completely circular shape is involved;

FIG. 2 is a vertical section taken on the line A—A in FIG. 1;

FIG. 3 is a vertical section taken on the line B—B in FIG. 1;

DETAILED DESCRIPTION OF THE INVENTION

Figure 4:
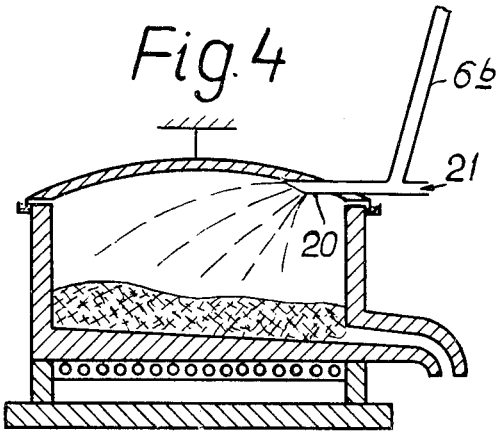
FIG. 4 is a vertical section showing a modification.

Having reference first to FIGS. 1 through 3, the refractory lined annular furnace roof 1 is suspended by a stationary suspension system 1a and closes the top of the refractory lined annular furnace vessel 2 which rests on a base 3 equipped with wheels 4, the annular shape being in this instance truly circular and the furnace vessel 2 being rotative partly or completely relative to the fixedly suspended roof 1. Although not shown, it is to be understood that a powered drive should be used. The annular loop has a large number of supply openings 5 to which the particulated materials are carried by a chute system 6. The particulated coke and metal oxides can be fed through this system in an intermixed condition. The stationary roof 1 is provided with a series of exhaust openings 7 connected to an exhaust collector pipe 8 for carrying away the gases formed by the reactions involved. The roof 1 is sealed to the annular walls of the furnace vessel 2, by running seals 9 which may be of the sand-seal type. The previously-referred-to tap holes and their runners are shown at 10, leading to below the surface of an annular collection of molten metal 11 in a collector 12, the metal running over the inner edge of this annular collector into a ladle 12.

The annular coke bed 14 is, in this instance, inductively heated, the electric inductor 15 below the vessel's bottom being formed by the usual coils 15 having the yoke 16 made of magnetic material, the inductor generally conforming to the construction of a typical multi-phase inductor, such as can induce a heating current through the coke bed, the yokes 16 serving to concentrate the induced field.

The bottom or hearth of the furnace vessel is radially corrugated to form the radial ridges 17 and valleys 18, the latter declining towards the tapping holes 10 which are, of course, registered with the valley bottoms.

In this instance, intermixed particulated oxides and coke are fed by a distributor 19 through the chute system 6. It is to be understood that initially the coke bed 14 is formed on the hearth, the cover 1 being removable to permit this, the cover 1 has been reapplied, and the inductor coils 15 powered so that the coke bed has reached an appropriate incandescent state. The radially distributed openings 5, therefore, discharge the intermixed coke and oxides to the top of the bed 14, the carbon and oxygen combining to produce gases drawn off by the various exhaust openings 7. The reduction process starts with the constant production of molten metal.

Figure 10:
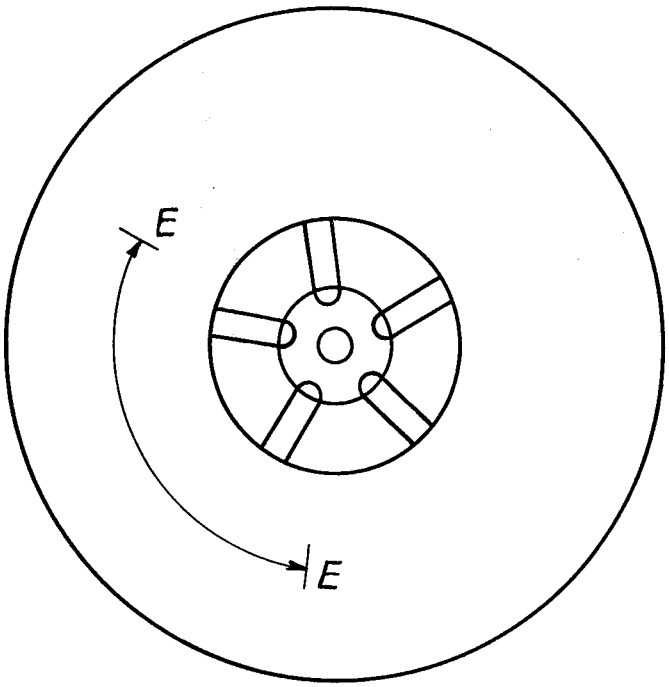
FIG. 10 shows the circular contour of the hearth.
Figure 11:
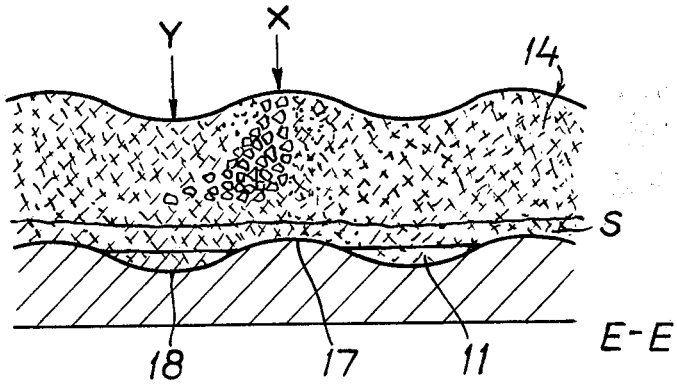
FIG. 11 is a cross section taken on the line E—E in FIG. 10 and showing the ridges and valleys of the hearth bottom together with the coke bed, possible slag layer, and the molten metal.

Going now to FIGS. 10 and 11, which both show the radial contour of the furnace 2 and the hearth ridges 17 and valleys 18, it can be seen that the liquid metal 11 collects in the valleys 18, and flows completely separated in the circumferential direction of the hearth, by the ridges 17. These valleys 18 decline as shown by FIG. 2, to the tapping arrangements 10, the molten metal continuously running into the collector 12. When the particulated oxides are in the form of ore, particularly iron ore, a slag is formed as shown at S in FIG. 11, the slag floating on the circumferentially discontinuos streams of iron 11 and the coke bed 14 floating on the slag.

In FIG. 4 the modification shows the annular furnace and its roof as being stationary, the mixture of oxide and coke being introduced by a chute system 6a similar to the system 6, but in this instance, ejected through the jet pipes 20, the streams of particles being fluidized by the introduction of compressed gas at 21.

Figure 5:
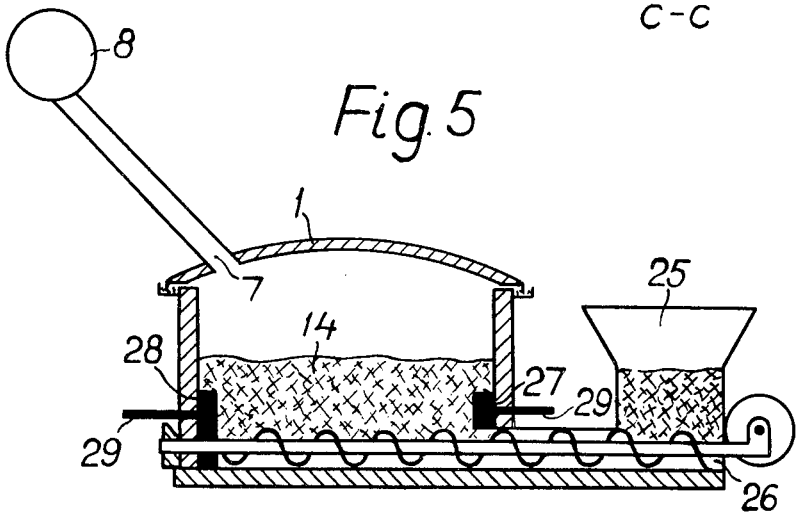
FIG. 5 is a vertical section showing another modification.

FIG. 5 serves to show that the mixture can be introduced by way of a hopper 25 with a screw conveyor 26 extending through the coke bed 14, it being of particular interest to note that in this instance a plurality of graphite conductors 27 and 28 are positioned inside of the furnace vessel and in direct contact with the coke bed 14, so that by powering these conductors through power lines 29 with suitably phased AC currents, an electric heating current can be formed in the coke bed in its annular or circular direction, as in the case when using the inductors 15 previously referred to.

Figure 6:
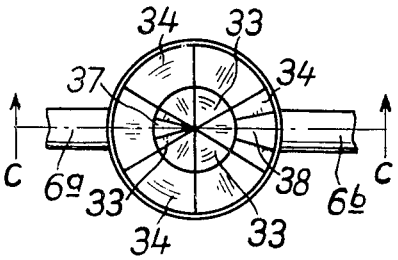
FIg. 6 is a plan view looking down into a distributor valve which may be used for the feeding of the particulated coke and oxides.
Figure 7:
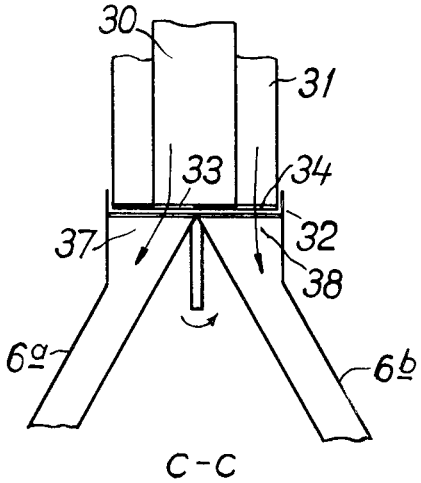
FIG. 7 is a vertical section taken on the line C—C in FIG. 6.

FIGS. 6 and 7 show an example of how the chute system 6 may be fed selectively. Thus, the distributor 19 is, in this case, in the form of a valve 32 fed through one of the concentric tubes 30 and 31 with the oxides, while the coke is fed through the other one of the tubes, holes 33 and 34 in the bottoms of these tubes being registered alternately by holes 37 and 38 in the tops of the various chutes of the chute system 6.

In this case it would be the furnace roof that rotates so the chute system 6 turns with it, and the various holes are arranged so that as alternate ones of the chutes, such as indicated at **6*a* in FIG. 1, register above the valleys 18, the oxides are discharged to these valleys, while the coke is discharged through the intervening arms 6*b* of the chute system, to the ridges 17. The top surface of the coke bed 14, at least generally, corresponds in contour to the furnace hearth so, as shown by FIG. 11, the coke discharge will be as indicated at X in FIG. 11,** while the oxide charging will be as indicated at Y in this figure.

By making the chute system 6 with each branch having a large multiplicity of distributor pipes opening above the hearth, uniform charging of the hearth in the radial direction is possible. By relative rotation between the roof and the hearth, circumferential uniformity is possible. The relative rotation may be oscillatory such as through an angle of 30°, for example. If the hearth is rotatively oscillated, it should be done slow enough to assure that the molten metal remains in the valleys and separated by the ridges of the hearth.

Usually the slag will form, the coke bed floating on the slag so that it has substantial mobility, at least over the valleys holding the molten metal. The continuous tapping of the molten metal from the valleys can also withdraw the slag which can be separated later from the melt. Depending on the tapping arrangements, the slag can be tapped off with the molten metal sufficiently fast to keep the slag in the valleys and prevent it from forming as a continuous layer extending throughout the annular hearth beneath the coke bed.

Figure 8:
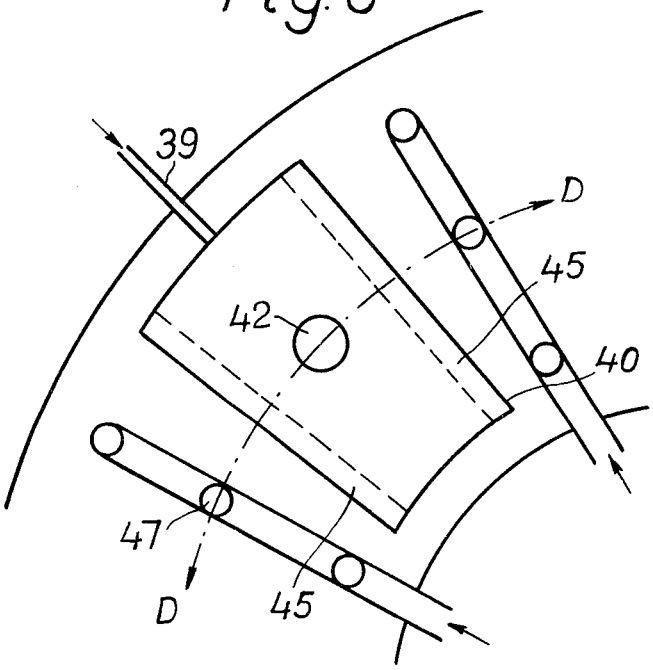
FIG. 8 is a horizontal section showing a modified coke-oxides feeding arrangement.
Figure 9:
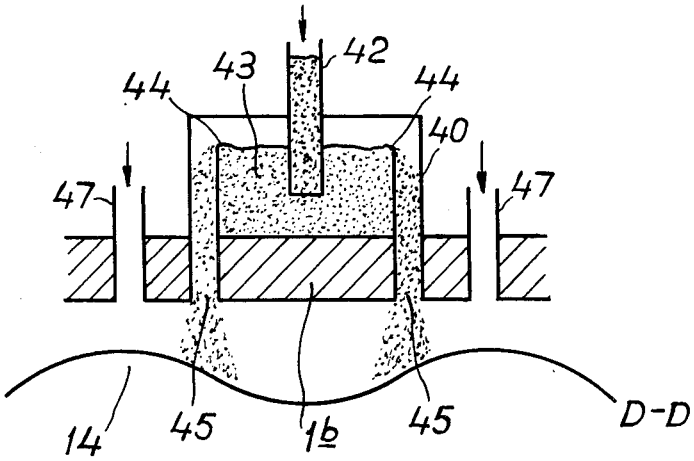
FIG. 9 is a cross section taken on the line D—D in FIG. 8.

In FIGS. 8 and 9, a pressurized gas is applied at 39 to a fluidizer 40 positioned in the furnace roof **1*b*, the particulated metal oxides being fed in at 42 to form a fluidized bed 43 from which it flows over spillways 44 and feeding openings in the roof 1*b*, to fall on the sloping sides of the ridges formed in the top surface of the bed 14, due to the corrugated hearth. The particulated coke required to maintain the bed, is fed through the roof 1*b* through openings 47** which register with the ridges formed in the coke bed's upper surface. Radially there should be a large number of such arrangements to assure radially uniformed feeding.

What is claimed is:

1. A furnace for producing molten metal from particulated metal oxides, comprising an annular hearth having a radially corrugated bottom forming radial valleys interspaced by radial ridges, a bed of particulated coke on said bottom and which is continuous in the bottom's annular direction, electric means for heating said bed to incandescence by an electric current passed through the bed in said direction, feeding means for feeding said oxides and additional particulated coke to said bed, said oxides being reduced by the incandescent bed to molten metal which flows into said vallyes, and means for removing said molten metal from said valleys so that said ridges prevent the molten metal from forming a melt that is continuous in said annular direction.

2. The furnace of claim 1 in which said electric means is an electric inductor below said hearth.

3. The furnace of claim 1 in which said electric means comprises electric conductors directly contacting said bed.

4. The furnace of claim 1 in which said hearth has tapping holes formed at the inner ends of said valleys.

5. The furnace of claim 4 in which said valleys decline to said tapping holes.

6. The furnace of claim 5 in which radial runners outside of said hearth extend inwardly from said tapping holes to a central location encircled by the furnace, and a molten metal collector at said location receives the molten metal from said runners.

7. The furnace of claim 1 in which said hearth is circular and is covered by a correspondingly shaped roof, and said hearth and roof are to some degree at least rotative relative to each other, said feeding means being positioned through said roof.

8. The furnace of claim 7 in which said feeding means feeds said particulated oxides and additional coke separately and respectively to said valleys and ridges.

9. The furnace of claim 1 in which said feeding means forces said oxides and additional coke into said bed below its upper level.

10. The furnace of claim 1 in which said feeding means forms said oxides and additional coke into pressurized-gas fluidized flows which are fed above said coke bed.

11. A method for producing molten metal from particulated metal oxides, comprising forming an annular continuous bed of particulated coke on an annular electrically non-conductive hearth, passing an electric current through said bed in its annular direction and so as to heat said coke to incandescence, feeding said oxides to said bed for reduction to form molten metal, and confining said molten metal against forming an annular continuous melt on said hearth.

12. The method of claim 11 in which the molten metal is confined at annularly interspaced locations on said hearth and said oxides and additional particulated coke are fed to said bed to extend said reduction and form increasing amounts of the molten metal, while removing molten metal from said locations to prevent the formation of said annular continuous melt.

* * * * *